US010998603B2

(12) United States Patent
Kim

(10) Patent No.: US 10,998,603 B2
(45) Date of Patent: May 4, 2021

(54) RADIO FREQUENCY FILTER HAVING CAVITY STRUCTURE

(71) Applicant: KMW INC., Hwaseong-si (KR)

(72) Inventor: Joung-hoe Kim, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 16/393,758

(22) Filed: Apr. 24, 2019

(65) Prior Publication Data

US 2019/0252750 A1 Aug. 15, 2019

Related U.S. Application Data

(63) Continuation of application No. PCT/KR2017/011444, filed on Oct. 17, 2017.

(30) Foreign Application Priority Data

Oct. 25, 2016 (KR) ..... 10-2016-0139478

(51) Int. Cl.
*H01P 1/207* (2006.01)
*H01P 1/213* (2006.01)
(Continued)

(52) U.S. Cl.
CPC ..... *H01P 1/2138* (2013.01); *H01P 1/04* (2013.01); *H01P 1/207* (2013.01); *H01P 1/2133* (2013.01);
(Continued)

(58) Field of Classification Search
CPC ..... H01P 1/2133; H01P 1/207; H01P 1/2136; H01P 7/04; H01P 7/06; H01P 7/10
(Continued)

(56) References Cited

U.S. PATENT DOCUMENTS 6,384,699 B1 * 5/2002 Henningsson ..... H01P 7/04 333/202
2015/0116058 A1 4/2015 Lee et al.
2016/0204493 A1 7/2016 Park et al.

FOREIGN PATENT DOCUMENTS

CN 10-1976750 A 2/2011
CN 202259614 U 5/2012
(Continued)

OTHER PUBLICATIONS

International Search Report for PCT/KR2017/011444 dated Jan. 22, 2018 and its English translation.
(Continued)

*Primary Examiner* — Stephen E. Jones

(57) ABSTRACT

The present disclosure relates to a radio frequency filter having a cavity structure, and including a housing having internally a hollow space and an open side to provide at least one cavity, at least one resonance element located in the hollow space of the housing, a cover configured to have at least one groove which is internally threaded, recessed at a predetermined diameter and depth at a position corresponding to the resonance element, and has a bottom portion that is thinner than other portions, and to close the open side of the housing, and at least one frequency tuning screw configured to threadedly mate with the groove of the cover. When the frequency tuning screw threadedly mates with the groove, a bottom surface of the groove is depressed by the frequency tuning screw toward the resonant element.

5 Claims, 4 Drawing Sheets

(51) Int. Cl.

| | |
|---|---|
| ***H01P 7/06*** | (2006.01) |
| ***H01P 11/00*** | (2006.01) |
| ***H01P 1/04*** | (2006.01) |
| ***H01P 7/10*** | (2006.01) |

(52) U.S. Cl.
CPC ..... *H01P 7/06* (2013.01); *H01P 7/10* (2013.01); *H01P 11/00* (2013.01)

(58) Field of Classification Search
USPC ..... 333/223, 222, 224, 226, 202, 205, 207, 333/219.1, 233, 232, 231
See application file for complete search history.

(56) References Cited

FOREIGN PATENT DOCUMENTS

| | | | |
|---|---|---|---|
| CN | 203134747 | U | 8/2013 |
| CN | 204315704 | U | 5/2015 |
| CN | 204927465 | U | 12/2015 |
| JP | H11-088006 | A | 3/1999 |
| JP | 2004-241843 | A | 8/2004 |
| JP | 2016-501491 | A | 1/2016 |
| KR | 10-0394801 | A | 8/2003 |
| KR | 10-2004-0100084 | A | 12/2004 |
| KR | 20-2011-0000320 | A | 1/2011 |
| KR | 10-2011-0074290 | A | 6/2011 |
| KR | 10-2014-0026235 | A | 3/2014 |
| KR | 10-1485066 | A | 1/2015 |
| KR | 10-2015-0049452 | A | 5/2015 |
| WO | 00/62369 | A1 | 10/2000 |
| WO | 2016068512 | A1 | 5/2016 |

OTHER PUBLICATIONS

Chinese office action dated Apr. 10, 2020 for Chinese Application No. 201780063691.1 and its English translation.
Extended European Search Report dated Apr. 24, 2020 for European Application No. 17864539.6.
Japanese office action dated Nov. 10, 2020 for Japanese Application No. 2019-520385 and its English translation.

* cited by examiner

RADIO FREQUENCY FILTER HAVING CAVITY STRUCTURE

CROSS-REFERENCE TO RELATED APPLICATIONS

This application is a Continuation of International Application No. PCT/KR2017/011444, filed on Oct. 17, 2017, which claims the benefit of and priority to Korean Patent Application No. 10-2016-0139478, filed on Oct. 25, 2016, the content of which are herein incorporated by reference in their entirety.

TECHNICAL FIELD

The present disclosure in some embodiments relates to a radio signal processing apparatus for use in a wireless communication system. More particularly, the present disclosure relates to a radio frequency filter having a cavity structure (hereinafter, abbreviated as 'filter'), such as a cavity filter.

BACKGROUND

A radio frequency filter having a cavity structure generally utilizes a metallic housing for providing a plurality of accommodation spaces or cavities having a shape such as rectangular parallelepiped and the like, in which dielectric resonance elements (DR) or resonance elements composed of a metallic resonance rod are each provided for generating superhigh frequency resonance. Further, such a radio frequency filter having a cavity structure is generally provided at its upper portion with a cover for shielding the open areas of the corresponding cavities, where the cover may have, as a configuration for tuning the filtering characteristic of the radio frequency filter, a plurality of tuning screws and nuts for fixing the corresponding tuning screws. An example radio frequency filter having a cavity structure is disclosed by Korean Patent Application Publication No. 10-2004-100084 (entitled "Radio Frequency Filter" and published on Dec. 2, 2004; inventors: Park, Jonggyu and 2 others) filed by the present applicant.

Radio frequency filters having such a cavity structure are used for processing radio transmit signals and receive signals in a radio communication system. Particularly in mobile communication systems, the radio frequency filters are typically used for base stations, repeaters or relays and the like.

Meanwhile, Korean Patent Application Publication No. 10-2014-0026235 (entitled 'Radio Frequency Filter with Cavity Structure', published Mar. 5, 2014, and invented by PARK, Nam Sin and 2 others) filed by the present applicant suggests a simplified filter structure for enabling easy frequency tuning without employing a coupling structure of tuning screws and fastening nuts. The above-mentioned Patent Application Publication No. 10-2014-0026235 suggests, when making a cover by pressing, die-casting or other processing of a plate-like base material of aluminum or magnesium material (including an alloy), to form one or more depressions at positions in the cover corresponding to resonance elements. In addition, a plurality of dot peen structures are formed at the depressions by embossing or pressing by embossing pins of an external embossing machine. Such a depression and dot peen structure are intended to replace the coupling structure of tuning screws and fastening nuts which have been conventionally used for frequency tuning, and to achieve appropriate tuning by narrowing the distance between the depression (and the dot peen structure) and the resonant element.

The technique disclosed by the above-mentioned Patent Application Publication No. 10-2014-0026235, which does not employs the conventional coupling structure of tuning screws and fastening nuts, can be compatible for the purpose of making a more compact and lightweight filter structure. In addition, this structure can eliminate Passive Intermodulation Distortion (PIMD) components caused by the discontinuous and non-uniform contact surfaces between the conventional frequency tuning screws and the screw holes of the housing, a junction between the dissimilar metals, or other reasons.

However, the technique disclosed by the above-mentioned Patent Application Publication No. 10-2014-0026235 is deficient that it requires an external embossing machine for the frequency tuning operation. The method of forming a plurality of dot peen structures at the depressions by embossing or pressing by the external embossing machine actually precludes the possibility of removing the dot peen structures once formed in an attempt to restore the depressions to their original shapes. As a result, the frequency tuning operation is irreversibly performed, which makes it difficult to tune the frequency.

DISCLOSURE

Technical Problem

The present disclosure in some embodiments seeks to provide a radio frequency filter having a cavity structure capable of tuning frequency without employing a conventional coupling structure of tuning screws and fastening nuts, which results in simpler manufacturing operations and lower manufacturing cost.

Further, the present disclosure in some embodiments aims to provide a radio frequency filter having a cavity structure in which tuning operations can be performed more easily, in addition to the above-mentioned object, by performing frequency tuning operations reversibly.

SUMMARY

At least one embodiment of the present disclosure provides a radio frequency filter having a cavity structure, and including a housing having internally a hollow space and an open side to provide at least one cavity, at least one resonance element located in the hollow space of the housing, a cover configured to have at least one groove which is internally threaded, recessed at a predetermined diameter and depth at a position corresponding to the resonance element, and has a bottom portion that is thinner than other portions, and to close the open side of the housing, and at least one frequency tuning screw configured to threadedly mate with the groove of the cover. When the frequency tuning screw threadedly mates with the groove, a bottom surface of the groove is depressed by the frequency tuning screw toward the resonant element.

Another embodiment of the present disclosure provides a radio frequency filter having a cavity structure, and including a housing having internally a hollow space and an open side to provide at least one cavity, at least one resonance element located in the hollow space of the housing, a cover configured to have at least one through hole which is internally threaded and has a predetermined diameter at a position corresponding to the resonance element, and has a bottom portion that is thinner than other portions, and to close the open side of the housing, a tuning metal plate disposed between the cover and the housing, and corresponding in size to the cover, and at least one frequency tuning screw configured to threadedly mate with the through hole of the cover. When the frequency tuning screw threadedly mates with the through hole, the tuning metal plate is depressed locally corresponding to and by the frequency tuning screw toward the resonant element.

Advantageous Effects

As described above, some embodiments of the present disclosure provide a radio frequency filter having a cavity structure for enabling frequency tuning without employing a conventional coupling structure of tuning screws and fastening nuts, results in simpler manufacturing operations and low-cost manufacturing. Further, in at least some other embodiments of the present disclosure, the frequency tuning operation can additionally be performed reversibly, facilitating the tuning operation.

DETAILED DESCRIPTION

Figure 1:
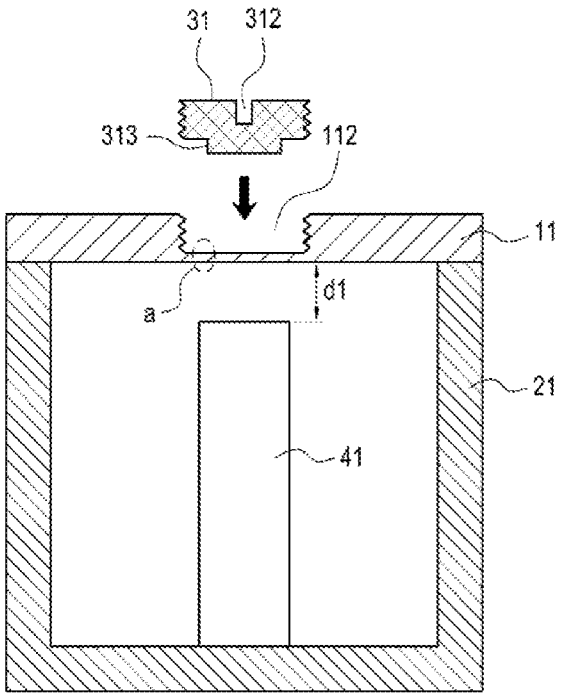
FIG. 1 is a partially cut-away sectional view of a radio frequency filter having a cavity structure according to a first embodiment of the present disclosure.

Hereinafter, some embodiments of the present disclosure will be described in detail with reference to the accompanying drawings. In the following description, like reference numerals designate like elements, although the elements are shown in different drawings. Further, in the following description of some embodiments, the size and shape of the same are somewhat simplified or partially exaggerated for convenience of explanation.

Figure 2:
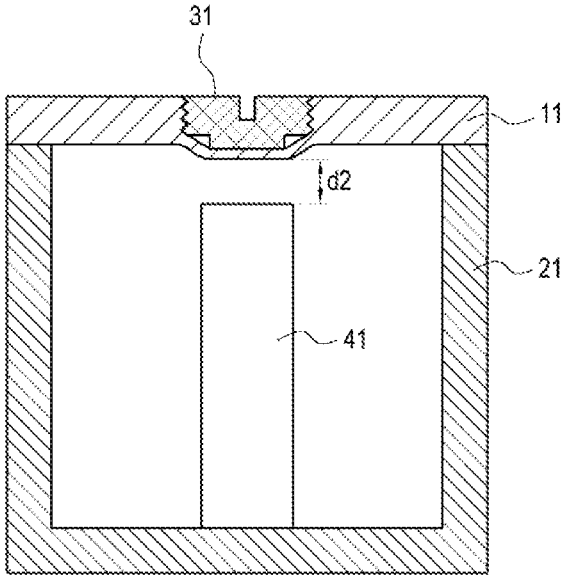
FIG. 2 shows the coupling of a separate part of FIG. 1.
Figure 3:
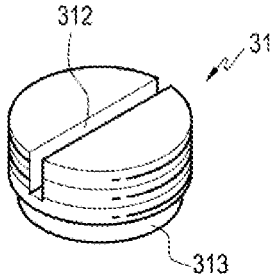
FIG. 3 is a perspective view of a frequency tuning screw of FIG. 1.

FIG. 1 is a partially cut-away sectional view of a radio frequency filter having a cavity structure according to the first embodiment of the present disclosure, in which a frequency tuning screw 31 is shown separated. FIG. 2 is the coupling of a separate part (i.e., the frequency tuning screw) in FIG. 1, and FIG. 3 is a perspective view of the frequency tuning screw of FIG. 1. Referring to FIGS. 1 to 3, the radio frequency filter having the cavity structure according to the first embodiment of the present disclosure, similar to prior art, is provided with an enclosure that is hollow inside having at least one cavity shielded from the outside. The enclosure is formed including a housing 21 having at least one cavity and opened at one side (e.g., upper side), and a cover 11 for sealing the open side of the housing 21. The cavity formed in the housing 21 is centrally formed with a resonance element 41 which is fixedly installed on a bottom surface of the housing 21.

The example illustrated in FIGS. 1 to 3 shows, for convenience of explanation, that the housing 21 forms, for example, a single cavity structure. However, in addition to this structure, the housing 21 may have a structure in which multiple cavities are connected in multiple stages, and each cavity may have a resonance element at its center. Although not shown in FIGS. 1 to 3, an input terminal and an output terminal of the RF filter may be formed on one side and the other side of the housing 21, respectively. When the housing is configured to have multiple cavities, the input and output terminals may be attached to the housing such that they are respectively connected to the input end cavity and output end cavity structures, respectively.

In this configuration, the housing 21, the cavity structure formed by the housing 21 and the structure of the resonance element 41 may be configured similar to the conventional ones, and the housing 21 and the resonance element 41 may be made of aluminum (alloy) material. In addition, the cover 11 according to at least one embodiment of the present disclosure may be made of the same material as that of the housing 21, that is, an aluminum-based material.

The cover 11 is formed with a groove 112 recessed at a predetermined diameter and depth at a portion corresponding to the resonance element 41 in the cavity of the housing 21. The thickness of a floor 'a' of the groove 112 is smaller than that of the rest of the cover 11, to form a thin membrane of the floor 'a'. For example, when the thickness of the rest of the cover 11 is about 2.0 to 3.0 mm, the thickness of the floor of the groove 112 may be about 0.1 to 0.3 mm. In addition, the diameter of the groove 112 may be about 4.0 to 4.5 mm.

The side surface of the groove 112 may be formed with a threaded coupling structure for coupling with the frequency tuning screw 31 for frequency tuning. In other words, the groove 112 generally has an internally threaded structure for allowing the frequency tuning screw 31 to be coupled in a threaded manner.

The frequency tuning screw 31 has its side surface formed with an externally threaded structure for threadedly mating with the groove 112, and its top formed with a coupling groove 312 of a suitable shape for engaging an external driver device (driver, a wrench, etc.). In the example of FIGS. 1 to 3, the coupling groove 312 is shown in a slotted form. The frequency tuning screw 31 has a downward protrusion 313 at its bottom, that is, at a portion contacting the floor 'a' of the groove 112. The protrusion 313 may be formed to have a stepped shape so that the bottom of the frequency tuning screw 31 has a smaller diameter. For example, when the diameter of the frequency tuning screw 31 is about 4.0 to 4.5 mm, the diameter of the protrusion 313 may be about 2.5 to 3.5 mm. The protrusion 313 may be formed to have a height of about 0.5 to 1.0 mm.

In the above-described filter structure, the frequency tuning screw 31 is engaged with and tightened against the groove 112 of the cover 11 during the frequency tuning operation. When the frequency tuning screw 31 is tightened, the protrusion 313 of the frequency tuning screw 31 pushes the floor 'a' of the groove 112. As a result, the floor 'a' of the groove 112 of the cover 11 is pushed toward the resonance element 41 inside its cavity, as shown more clearly in FIG. 2. This adjusts the distance between the bottom of the cover 11, that is, the floor 'a' of the groove 112 and the resonance element 41 (i.e., d1 in FIG. 1 and d2 in FIG. 2), which in turn adjusts the capacitance component between the cover 11 and the resonance element 41, and thereby adjusts the characteristic of the relevant filtering frequency.

At this time, where the floor 'a' of the groove 112 of the cover 11 is designed to have some elasticity, one can repeatedly tighten or untighten the frequency tuning screw 31 to perform the frequency property tuning.

The total height of the frequency tuning screw 31 including the protrusion 313 is appropriately determined taking account of the thickness of the cover 11 and the condition of being tightened during the tuning operation, so that the frequency tuning operation is complete without leaving the top of the tuning screw 31 protruded from the upper surface of the cover 11. This can optimize the overall appearance and size of the filter.

After the frequency tuning operation is completed, an adhesive resin (not shown) such as epoxy may be applied to the mating site of the frequency tuning screw 31 with the groove 112 of the cover 11 and to maintain the fixed state of the frequency tuning screw 31.

Figure 4:
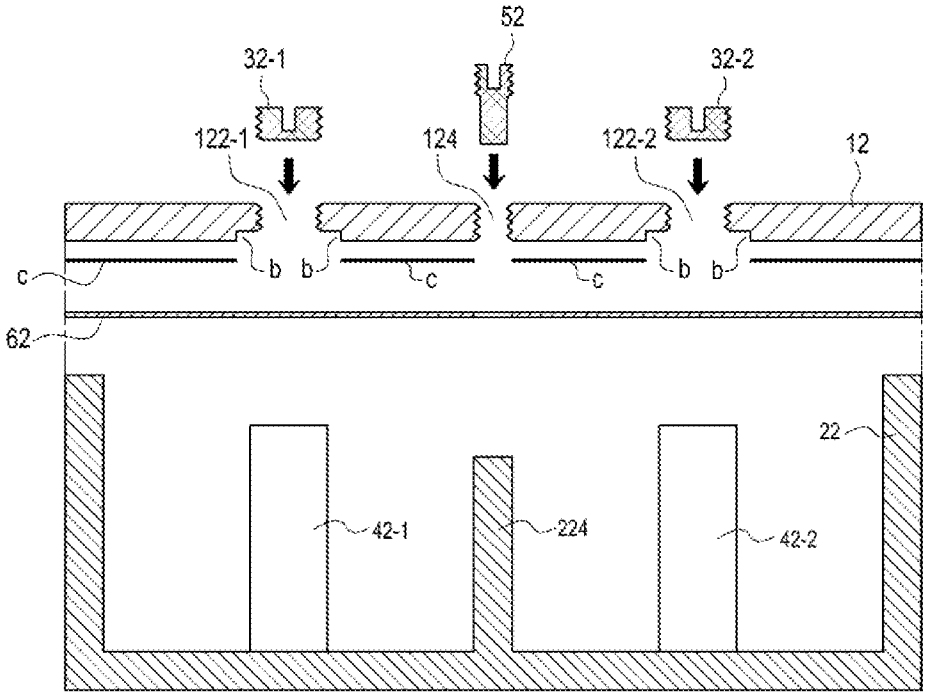
FIG. 4 is a partially cut-away sectional view of a radio frequency filter having a cavity structure according to a second embodiment of the present disclosure.
Figure 5:
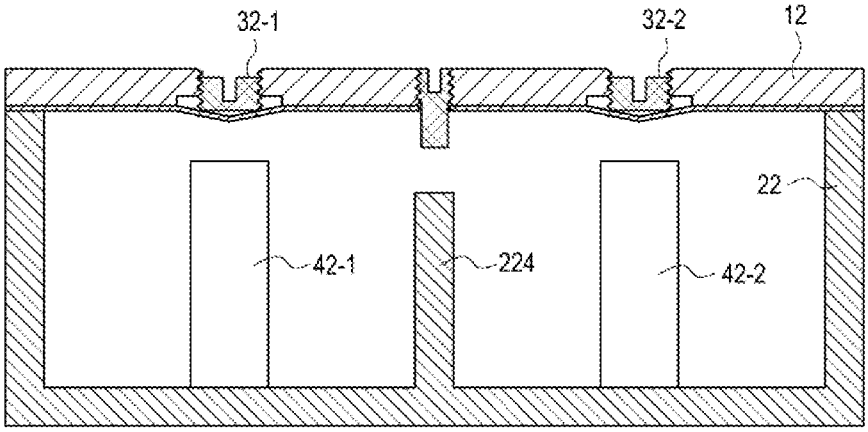
FIG. 5 shows the coupling of separate parts of FIG. 4.
Figure 6:
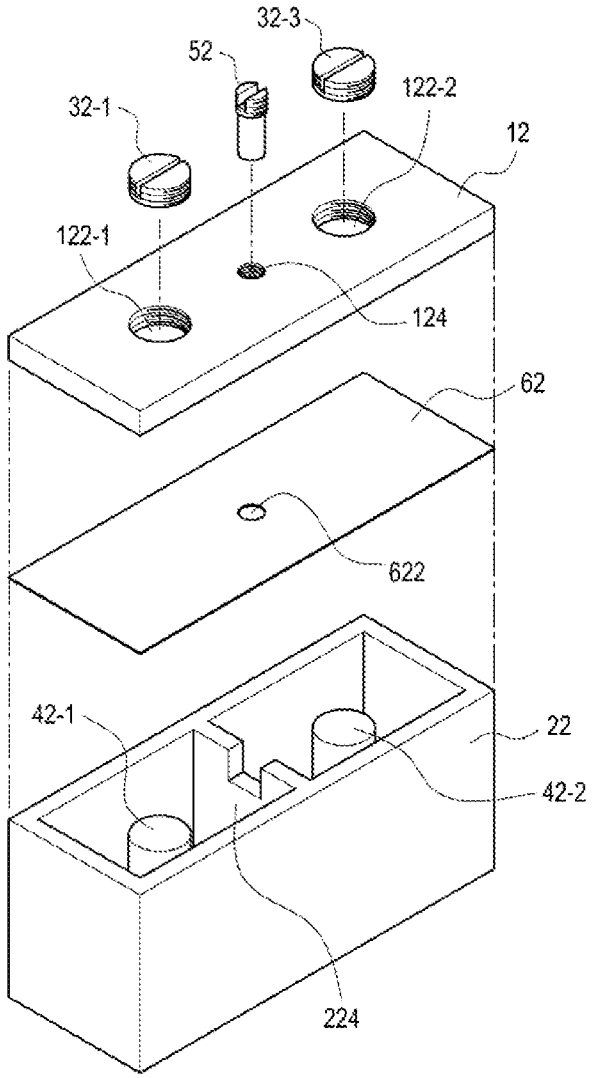
FIG. 6 is a perspective view of FIG. 4.

FIG. 4 is a partially cut-away sectional view of a radio frequency filter having a cavity structure according to a second embodiment of the present disclosure. FIG. 5 is shows the coupling of separate parts of FIG. 4. FIG. 6 is a perspective view of FIG. 4. Referring to FIGS. 4 to 6, a radio frequency filter according to the second embodiment of the present disclosure has, as with the structure of the first embodiment illustrated in FIGS. 1 to 3, an enclosure including a housing 22 opened at the upper side, and a cover 12 for sealing the upper side of the housing 22. The housing 22 internally has cavities provided centrally with resonance elements 42-1 and 42-2 (collectively indicated by 42) which are fixedly mounted on the bottom surface of the housing 22.

In the example of FIGS. 4 to 6, the housing 22 is illustrated as forming, for example, a structure having two cavities. Between the two cavities, a coupling window 224 is formed, which is a connecting passage structure for mutual coupling therebetween. The coupling window 224 may be formed in a partition wall disposed between the cavities as a corresponding void of a predetermined size. Although not shown in FIGS. 4 to 6, an input terminal of the relevant RF filter is provided to be connected to one of the two cavities of the housing 22, and an output terminal is provided to be connected to the other cavity.

In the filter according to the second embodiment of the present disclosure having the above structure, the cover 12 is provided with holes 122-1 and 122-2 (collectively indicated by 122) at portions corresponding to the respective resonance elements 42-1 and 42-2. The holes 122-1, 122-2 have a predetermined diameter and extend through the cover 12. The holes 122-1, 122-2 may have threaded side surfaces for threadedly mating with frequency tuning screws 32-1 and 32-2 (collectively indicated by 32) for frequency tuning. In other words, the holes 122 generally have an internally threaded structure for allowing the frequency tuning screws 32 to be coupled in a threaded manner.

The frequency tuning screws 32 each has its side surface formed with an externally threaded structure for threadedly mating with the holes 122. Here, in the example shown in FIGS. 4 to 6, the frequency tuning screws 32 are shown as having a generally uniform diameter from their upper ends to lower ends.

In the structure of the second embodiment shown in FIGS. 4 to 6, the cover 12 and the housing 22 have therebetween, for example, a thin metal plate 62 disposed for the frequency tuning operation. The metal plate 62 may be made of, for example, aluminum, copper or iron-based material, and it may have a thickness of about 0.05 to 0.2 mm.

The metal plate 62 may be fixedly attached to the cover 12 by a soldering method. For example, solder or a solder cream at 'c' in FIG. 4 may be supplied to sites properly preset on the bottom surface of the cover 12, and a reflow soldering process or the like may be performed to solder the metal plate 62 and the cover 12 together. Likewise, portions of the bottom surface of the metal plate 62 abutting the housing 22 may be fixedly attached to each other by a soldering method.

The lower ends of the through holes 122 of the cover 12 may be formed with an auxiliary groove '13' through an additional removal of edge portions of the through holes 122 to have their diameters relatively expanded. Accordingly, it can be seen that the through holes 122 are formed to have a stepped portion such that the lower ends partially have a wider diameter.

The auxiliary groove 'b' is a structure for preventing the application of the solder cream, for example, during the soldering operation with the metal plate 62. For example, the soldering operation may use a method of printing the solder cream on the lower surface of the cover 12. In such a case, the solder cream is prevented from being printed at the portion where the auxiliary groove 'b' is formed. As described above, clean portions of the metal plate 12 that are not soldered with the cover 12 due to auxiliary grooves 'b' of the through holes 122 include the sites contacted by the frequency tuning screws 32 with some tolerance added to the sites, which allows the corresponding areas of the metal plate 12 to the frequency tuning screws 32, to be pushed by the frequency tuning screws 32 by certain degrees.

With the above-described filter structure, in the frequency tuning operation, the frequency tuning screws 32 are coupled and tightened to the through holes 122 of the cover 12. As the frequency tuning screws 32 are respectively tightened, the lower ends of the screws 32 pass through the holes 122 and then abut their corresponding portions on the upper surface of the metal plate 62 to depress the metal plate 62. As a result, as shown more clearly in FIG. 5, the areas of the metal plate 62 corresponding to the tuning screws 32 are pushed toward the resonance elements 42 inside the cavity. This allows the distances to be adjusted between the lower surface of the metal plate 62 and the resonant elements 42, and thereby controls the characteristic of the filtering frequency.

Meanwhile, in case where the metal plate 62 has certain elasticity, the tuning operation on the frequency characteristics can be performed by repeatedly tightening or untightening the tuning screws 32.

In addition, the total height of the frequency tuning screw 32 is appropriately determined taking account of the thickness of the cover 12 and the condition of being tightened during the tuning operation, so that the frequency tuning operation is complete without at least leaving the top of the tuning screws 32 protruded from the upper surface of the cover 12.

On the other hand, in the embodiment of FIGS. 4 to 6, a coupling tuning screw 52 for coupling between cavities is provided on the cover 12, in addition to the frequency tuning screws 32. In other words, the coupling tuning screw 52 may be formed to be threadedly screwed into a screw hole 124 formed in the cover 12 at the position corresponding to the coupling window 224, so that it may protrude toward the coupling window 224.

In the above structure, a through hole 622 is formed in the corresponding portion of the metal plate 62 so that the coupling tuning screw 52 can protrude toward the coupling window 224.

As described above, the radio frequency filter may be configured as illustrated by some embodiments of the present disclosure, and other various embodiments and modifications may be made in the present disclosure. For example, although the above description states that the frequency tuning screws 32 according to the second embodiment shown in FIGS. 4 to 6 have a generally uniform diameter, they may be configured to further have protrusions which are formed at their lower ends as shown in FIGS. 1 to 3. In this case, the through holes 122 formed in the cover 120 shown in FIGS. 4 to 6 can be configured without the auxiliary grooves 'b' being formed at the lower ends thereof.

In addition, the resonant elements may be made as separate components to be attached to the internal floor of the housing of the radio frequency filter. Since the housing and the resonant element may be made of the same material, they can be integrally formed by a die casting method. Alternatively, as in the technique disclosed by the above-mentioned Patent Application Publication No. 10-2014-0026235, the housing and the resonance element inside the housing may be integrally formed by a pressing process as a whole.

It should be understood that the detailed structure, size, and the like of specifically detailed components such as frequency tuning screws, grooves, through holes, etc., as well as the number and type of cavities provided in the enclosure can be variously changed.

Therefore, various modifications and variations of the present disclosure can be made without departing from the idea and scope of the present disclosure as defined by the appended claims and their equivalents rather than the particularly illustrated embodiments.

CROSS-REFERENCE TO RELATED APPLICATION

This application claims priority under 35 U.S.C § 119(a) of Patent Application No. 10-2016-0139478, filed on Oct. 25, 2016 in Korea, the entire content of which is incorporated herein by reference. In addition, this non-provisional application claims priority in countries, other than the U.S., with the same reason based on the Korean patent application, the entire content of which is hereby incorporated by reference.

The invention claimed is:

1. A radio frequency filter having a cavity structure, the radio frequency filter comprising:

a housing having internally a hollow space and an open side to provide at least one cavity;

at least one resonance element located in the hollow space of the housing;

a cover having at least one groove which has an internally threaded surface, recessed at a predetermined diameter and depth at a position corresponding to the resonance element, and has a bottom portion that is thinner than other portions, and closing the open side of the housing; and at least one frequency tuning screw configured to threadedly mate with the threaded surface of the groove, wherein when the at least one frequency tuning screw threadedly mates with the threaded surface of the groove, a bottom surface of the groove is depressed by the frequency tuning screw toward the resonant element, wherein the at least one frequency tuning screw has a first diameter at its threaded portion, and no portion of the at least one frequency tuning screw has a larger diameter than the first diameter, and wherein when the at least one frequency tuning screw threadedly mates with the groove, a top surface of the at least one frequency tuning screw is not higher than a top surface of the cover, and wherein the threaded surface and the bottom portion are integrally formed on the groove.

2. The radio frequency filter of claim 1, wherein the at least one frequency tuning screw has a lower end formed with a protrusion which protrudes downward.

3. A radio frequency filter having a cavity structure, the radio frequency filter comprising:

a housing having internally a hollow space and an open side to provide at least one cavity;

at least one resonance element located in the hollow space of the housing;

a cover having at least one through hole which is internally threaded and has a predetermined diameter at a position corresponding to the resonance element, and closing the open side of the housing;

a tuning metal plate disposed between the cover and the housing, and corresponding in size to the cover; and at least one frequency tuning screw configured to threadedly mate with the through hole of the cover, wherein when the at least one frequency tuning screw threadedly mates with the through hole, the tuning metal plate is depressed locally corresponding to and by the frequency tuning screw toward the resonant element, wherein the at least one frequency tuning screw has a first diameter at its threaded portion, and no portion of the at least one frequency tuning screw has a larger diameter than the first diameter, and wherein when the at least one frequency tuning screw threadedly mates with the at least one through hole, a top surface of the at least one frequency tuning screw is not higher than a top surface of the cover, and wherein the through hole of the cover has a lower end formed with a stepped portion so as to have a larger diameter than a diameter of other portions, and wherein the tuning metal plate is fixedly attached to the cover by a soldering method.

4. The radio frequency filter of claim 3, wherein the housing has at least two cavities, the at least two cavities has a coupling window formed as a connection passage between the cavities, the cover has a screw hole formed in the cover at a position corresponding to the coupling window, the metal plate is provided with a through hole for coupling tuning at a position corresponding to the screw hole formed in the cover, and a coupling tuning screw, which threadedly mates with the screw hole, protrudes toward the coupling window through the screw hole and the through hole of the metal plate for coupling tuning.

5. The radio frequency filter of claim 3, wherein the at least one frequency tuning screw has a lower end formed with a protrusion which protrudes downward.

* * * * *